US009202676B2

(12) United States Patent
Campbell et al.

(10) Patent No.: US 9,202,676 B2
(45) Date of Patent: Dec. 1, 2015

(54) METHOD AND SYSTEM FOR QUANTITATIVE AND QUALITATIVE ANALYSIS USING MASS SPECTROMETRY

(71) Applicant: DH Technologies Development Pte. Ltd., Singapore (SG)

(72) Inventors: John Lawrence Campbell, Milton (CA); James Hager, Mississauga (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 14/367,235

(22) PCT Filed: Nov. 28, 2012

(86) PCT No.: PCT/IB2012/002523
§ 371 (c)(1),
(2) Date: Jun. 20, 2014

(87) PCT Pub. No.: WO2013/093582
PCT Pub. Date: Jun. 27, 2013

(65) Prior Publication Data

US 2015/0235828 A1 Aug. 20, 2015

Related U.S. Application Data

(60) Provisional application No. 61/579,922, filed on Dec. 23, 2011.

(51) Int. Cl.
*H01J 49/00* (2006.01)
*H01J 49/42* (2006.01)

(52) U.S. Cl.
CPC ..... *H01J 49/0031* (2013.01); *H01J 49/4215* (2013.01)

(58) Field of Classification Search
USPC ..... 250/282, 281
See application file for complete search history.

(56) References Cited

U.S. PATENT DOCUMENTS

| | | | | |
|---|---|---|---|---|
| 7,038,197 | B2 | 5/2006 | Bateman et al. | |
| 8,044,347 | B2 | 10/2011 | Yamamoto et al. | |
| 2002/0063205 | A1 | 5/2002 | Green et al. | |
| 2004/0238737 | A1 | 12/2004 | Hager | |
| 2013/0151190 | A1 * | 6/2013 | Platt et al. | 702/123 |

FOREIGN PATENT DOCUMENTS

WO 2005-098899 10/2005

OTHER PUBLICATIONS

International Search Report from International Patent Application No. PCT/IB2012/002523, May 30, 2013.

* cited by examiner

*Primary Examiner* — Kiet T Nguyen

(57) ABSTRACT

In some embodiments, a quantitative analysis of at least one ion signal associated with a sample, which is detected by a mass spectrometer having at least two tandem quadrupole instruments, is employed to select one of the following operational modes for further mass analysis of the sample: (a) utilizing both quadrupole instruments as mass resolving filters, and (b) utilizing one quadrupole instrument as a mass resolving filter and utilizing the other as a linear ion trap. In some embodiments, the quantitative analysis of the ion signal comprises comparing the ion signal intensity with a predefined threshold.

20 Claims, 3 Drawing Sheets

METHOD AND SYSTEM FOR QUANTITATIVE AND QUALITATIVE ANALYSIS USING MASS SPECTROMETRY

RELATED APPLICATION

This application claims priority to U.S. provisional application No. 61/579,922 filed Dec. 23, 2011, which is incorporated herein by reference in its entirety.

FIELD

Embodiments of the present invention relate to methods and systems for mass spectrometry.

INTRODUCTION

Mass spectrometry (MS) is an analytical technique for determining the elemental composition of test substances, which has both quantitative and qualitative applications. For example, MS can be useful for identifying unknown compounds, determining the isotopic composition of elements in a molecule, and determining the structure of a particular compound by observing its fragmentation, as well as for quantifying the amount of a particular compound in a sample.

Mass spectrometry can operate by ionizing a sample using one of many different available methods to form a stream of charged particles, e.g., an ion beam. A downstream mass analyzer can then subject the ion beam to mass differentiation (in time and/or space) to separate different particle populations in the ion beam according to mass-to-charge (m/z) ratio for detection by an ion detector. Intensities of the mass-differentiated particle populations can be determined in order to compute analytical data of interest, e.g. the relative concentrations of the different particle populations, mass-to-charge ratios of product or fragment ions, but also other potentially useful analytical data.

The performance of many conventional mass spectrometers can be limited by a number of different factors such as, for example, sensitivity and space charge effects. Accordingly, improved mass spectrometer systems, as well as methods of mass spectrometry, are desirable.

SUMMARY

In accordance with one broad aspect, certain embodiments of the applicants' teachings are directed to a method of performing mass analysis of a sample using a mass spectrometer that is capable of operating in two different operational modes. The method comprises using the mass spectrometer to detect at least one mass-to-charge (m/z) ion signal associated with the sample, determining an intensity of the ion signal, and selecting one of the operational modes of the mass spectrometer based on a comparison of the measured ion signal intensity with a predefined threshold to perform mass analysis of the sample.

In some embodiments, one of the operational modes provides a lower sensitivity than that provided by another mode. In some embodiments, initially, the mass spectrometer can be utilized in the mode exhibiting lower sensitivity to detect at least one m/z ion signal associated with a sample. By way of example, a mass analyzer of the spectrometer can be scanned over a selected m/z range to detect the m/z ion signal. In some embodiments, if the ion signal intensity exceeds the threshold, the mass analysis of the sample is performed (e.g., continued) using the spectrometer in the lower sensitivity mode, and if the ion signal intensity is equal to or less than the threshold, the operational mode of the spectrometer is changed from the lower sensitivity mode to another mode and mass analysis of the sample is performed using the mass spectrometer in that mode, e.g., by changing the operational mode to another mode that exhibits a higher sensitivity.

In some embodiments, the mass spectrometer can comprise first and second tandem quadrupole instruments with the second quadrupole instrument positioned downstream from the first quadrupole instrument, where the first quadrupole instrument can be configured to operate as a mass resolving filter and the second quadrupole instrument can be configured to operate as a mass resolving filter or as a linear ion trap, e.g., based on RF and/or DC potentials applied to its quadrupole rod array and one or more end electrodes. In some embodiments, in such a mass spectrometer, one of the operational modes (herein referred to as "product ion mode" or for brevity "PI mode") comprises operating both quadrupole instruments as mass resolving filters and the other operational mode (herein referred to as "enhanced product ion mode" or for brevity "EPI mode") comprises operating the first quadrupole instrument as a mass resolving filter and operating the second quadrupole instrument as an ion trap.

In some embodiments, in the above mass spectrometer having the quadrupole instruments, at least one ion signal associated with a sample can be detected, e.g., by operating the mass spectrometer in the PI mode to scan over a selected m/z range, e.g., in a range of about 50 to about 2000 Th (where "Th" stands for "Thomsons"—an accepted unit in the field of mass spectrometry for units of m/z). If the intensity of the ion signal exceeds a predefined threshold, the operation of the mass spectrometer can be continued in said PI mode to perform mass analysis of the sample, and if the intensity of the ion signal is equal to or less than the threshold, the operational mode of the mass spectrometer can be changed from the PI mode to the EPI mode to perform mass analysis of the sample.

In some embodiments, the above mass spectrometer can comprise, in addition to the first and second quadrupole instruments, a collision cell that can be disposed between the two quadrupole instruments. In some embodiments, the collision cell can be implemented as a quadrupole instrument. In some such embodiments, the step of detecting an ion signal associated with the sample can comprise obtaining m/z data corresponding to at least one MRM (multiple reaction monitoring) transition of the sample. The MRM data can be obtained, and the intensity of the MRM transition can be measured and compared with a predefined threshold to determine whether to operate the mass spectrometer in the PI mode or to change the operational mode from the PI mode to the EPI mode. For example, if the MRM transition intensity exceeds the predefined threshold, the mass spectrometer is operated in the PI mode, and if the MRM transition intensity is equal to or less than the threshold, the mass spectrometer is operated in the EPI mode.

In some embodiments, the above mass spectrometer having first and second quadrupole instruments can be used to obtain m/z data corresponding to an SIM (selected ion monitoring) signal of the sample. The intensity of the SIM signal can be measured and compared with the predefined threshold. If the SIM signal intensity exceeds the predefined threshold, the mass spectrometer is operated in the PI mode to perform mass analysis of the sample, and if the SIM signal intensity is equal to or less than the predefined threshold, the mass spectrometer is operated in the EPI mode to perform mass analysis of the sample.

In some embodiments, the signal intensity can be generally related (e.g., proportional) to the intensity of an ion current measured by the detector of the mass spectrometer. In some embodiments in which counting detectors are employed, the signal intensity can be measured in total number of counts. In other embodiments, analog techniques can be employed to measure the ion current. In some such embodiments, the signal intensity can be measured in volts (V). Other techniques for measuring signal intensity are also within the scope of the applicants' teachings.

In some embodiments in which a counting detector, such as a discrete dynode electron multiplier operating in pulse counting mode, is employed, the predefined threshold can be a selected number of counts, e.g., 3000, 4000, 5000, 6000 or 7000 counts.

In some embodiments, a reference ion intensity, e.g., an m/z ion intensity associated with an analyte previously obtained by the mass spectrometer, can be employed as the predefined threshold.

In further aspects, in a mass spectrometer comprising at least first and second quadrupole instruments, wherein said second quadrupole instrument is capable of operating in at least two operational modes, a method of performing mass analysis of a sample is disclosed, which comprises passing a plurality of ions obtained from a sample through said quadrupole instruments to detect at least one ion associated with the sample, generating at least one m/z ion signal corresponding to said ion, determining an intensity of said at least one ion signal, selecting one of said operational modes of the second quadrupole instrument based on comparison of said determined ion signal intensity with a predefined threshold, and passing a plurality of ions obtained from the sample through the mass spectrometer while operating said second quadrupole instrument in said selected operational mode to obtain one or more mass spectra.

In further aspects, in a mass spectrometer comprising at least first and second quadrupole instruments, wherein said second quadrupole instrument is capable of operating in at least two operational modes, a method of performing mass analysis of a sample is disclosed, which comprises passing a plurality of ions obtained from a sample through said quadrupole instruments to detect at least one ion associated with the sample, generating at least one m/z ion signal corresponding to said ion, determining a signal-to-noise ratio (SNR) of said at least one ion signal, selecting one of said operational modes based on comparison of said SNR with a predefined threshold, and passing a plurality of ions obtained from the sample through said quadrupole instruments while operating the second quadrupole instrument in said selected operational mode to obtain one or more spectra. In some embodiments, the first quadrupole instrument is configured to operate as a mass resolving filter. In some embodiments, one of said operational modes corresponds to said second quadrupole instrument operating as a mass resolving filter ("product ion mode") and another of said operational modes corresponds to said quadrupole instrument operating as a linear ion trap ("enhanced product ion mode"). In some embodiments, the product ion mode is selected if the SNR is greater than the threshold (e.g., about 5% or about 10% above the threshold), and the enhanced product ion mode is selected if the SNR is less than the threshold (e.g., about 5% or about 10% less than the threshold).

In accordance with further broad aspects, a method of combined quantitative and qualitative mass analysis of a sample in a hybrid triple quadrupole-linear ion trap mass spectrometer is disclosed, in which quantitative information regarding at least one m/z signal intensity of a sample is employed to trigger one of at least two operational modes of the spectrometer for qualitative mass analysis of the sample. For example, at least an intensity of at least one m/z ion signal, e.g., an MRM or an SIM transition intensity, can be employed to trigger one of the two operational modes of the mass spectrometer: (a) a mode in which at least one of the quadrupole instruments functions as a linear ion trap, or (b) a mode in which none of the quadrupole instruments functions as a linear ion trap. In accordance with further broad aspects, some embodiments of the applicants' teachings are directed to a method of optimizing sensitivity in a hybrid triple quadrupole-linear ion trap mass spectrometer. According to such embodiments, a survey m/z scan can be obtained to detect at least one m/z ion signal associated with the sample, and an intensity of the at least one m/z ion signal can be determined. If the intensity of the at least one m/z ion signal is above the predefined threshold value, the mass spectrometer is operated in a product ion (PI) mode for mass analysis of the sample. If the intensity of the at least one m/z ion signal is equal to or below the predefined threshold, the mass spectrometer is operated in enhanced product ion (EPI) mode for mass analysis of the sample. According to other broad aspects, a method for performing mass analysis of a sample using a mass spectrometer capable of operating in at least two different operational modes is disclosed, which comprises detecting at least one ion signal associated with the sample, and selecting one of the operational modes based on application of a predefined criterion to the detected ion signal. For example, as discussed above, in some embodiments, the intensity of the ion signal can be compared with a predefined threshold to select one of the operational modes. In other embodiments, a pattern of two or more ion signals detected over a range of m/z values can be utilized as the criterion to select one of the operational modes. For example, the number of ion signals within a preselected range of m/z values can be compared with a predefined threshold to select one of the operational modes.

In accordance with further broad aspects, a mass spectrometer for mass analysis of a sample is disclosed, which comprises an ion source for ionizing at least a portion of the sample to generate a plurality of ions, a first quadrupole instrument for receiving at least a portion of said ions, a second quadrupole instrument positioned downstream from said first quadrupole instrument and in communication therewith to receive ions therefrom, and a controller in communication with said second quadrupole and said detector. The controller can be configured to determine an intensity of at least one m/z ion signal detected by the detector and to effect said second quadrupole instrument to operate as a mass resolving filter or as a linear ion trap based on comparison of said ion intensity with a predefined threshold. By way of example, in some embodiments, the controller can instruct a power supply, e.g., via application of control signals, to apply appropriate RF and/or DC potentials to the quadrupole rod array and the exit lens of the second quadrupole instrument to configure that instrument to operate as a mass resolving filter or a linear ion trap.

In some embodiments, the above mass spectrometer comprises a collision cell disposed between said first and second quadrupole instruments. In some embodiments, the collision cell is implemented as a quadrupole instrument.

These and other features of the applicants' teachings are set forth and described herein.

DRAWINGS

A detailed description of various embodiments is provided herein below with reference, by way of example, to the following drawings. The skilled person in the art will understand that the drawings, described below, are for illustration purposes only. The drawings are not intended to limit the scope of the applicant's teachings in any way.

Figure 3:
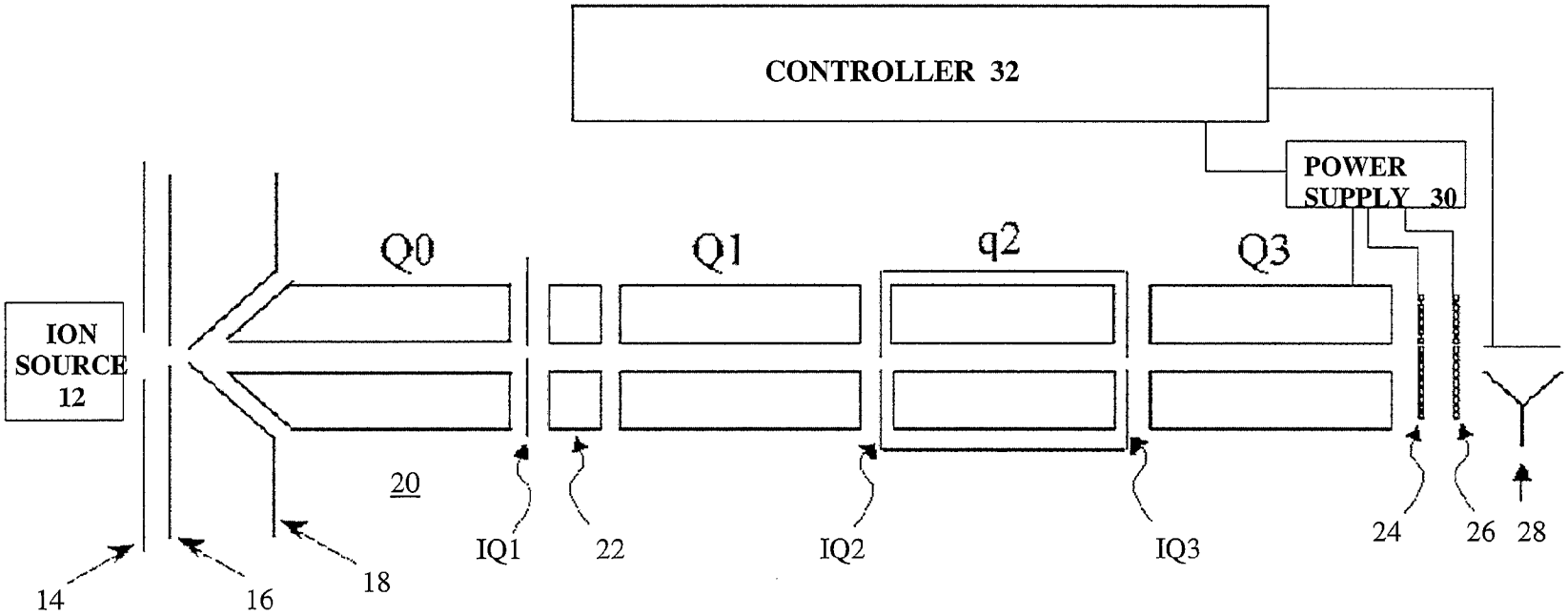

FIG. 3 schematically illustrates a mass spectrometer according to an embodiment of the applicants' teachings.

It will be understood that the drawings are exemplary only and that all reference to the drawings is made for the purpose of illustration only, and is not intended to limit the scope of the embodiments described herein below in any way. For convenience, reference numerals may also be repeated (with or without an offset) throughout the figures to indicate analogous components or features.

DESCRIPTION OF VARIOUS EMBODIMENTS

It will be appreciated that for clarity, the following discussion will explicate various aspects of embodiments of the applicant's teachings, but omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments may not require certain of the specifically described details in every implementation, which are set forth herein only to provide a thorough understanding of the embodiments. Similarly it will be apparent that the described embodiments may be susceptible to slight alteration or variation according to common general knowledge without departing from the scope of the disclosure. Aspects of the applicant's teachings may be further understood in light of the following examples and description of various embodiments, which should not be construed as limiting the scope of the applicant's teachings in any way.

Various terms are used herein consistent with their ordinary meanings in the art. For example, the term "mass resolving filter" is known in the art and is used herein consistent with its ordinary meaning to refer to an instrument that allows the passage of ions having certain m/z ratios, e.g., by providing stable trajectories for those ions, but blocks the passage of ions having certain other m/z ratios, e.g., by subjecting those ions to unstable trajectories. For example, a mass resolving filter can comprise a quadrupole analyzer having an array of quadrupole rods to which radio frequency (RF) and direct current (DC) potentials can be applied to provide stable trajectories for ions having certain m/z ratios, thereby allowing the passage of those ions from an inlet to an outlet of the analyzer. The term "linear ion trap" is known in the art and is used herein consistent with its ordinary meaning. For example, a linear ion trap can refer to a trap in which a quadrupolar field is employed to confine ions in the radial dimension and an electric field (e.g., a DC electric field) at one or both ends of the trap is employed to confine the ions in the axial dimension. The detection sensitivity of a mass spectrometer, or of an operational mode of a mass spectrometer, is used herein consistent with it ordinary meaning to refer to the lowest concentration of ions that can be detected by that mass spectrometer and/or using that operational mode.

Figure 1:
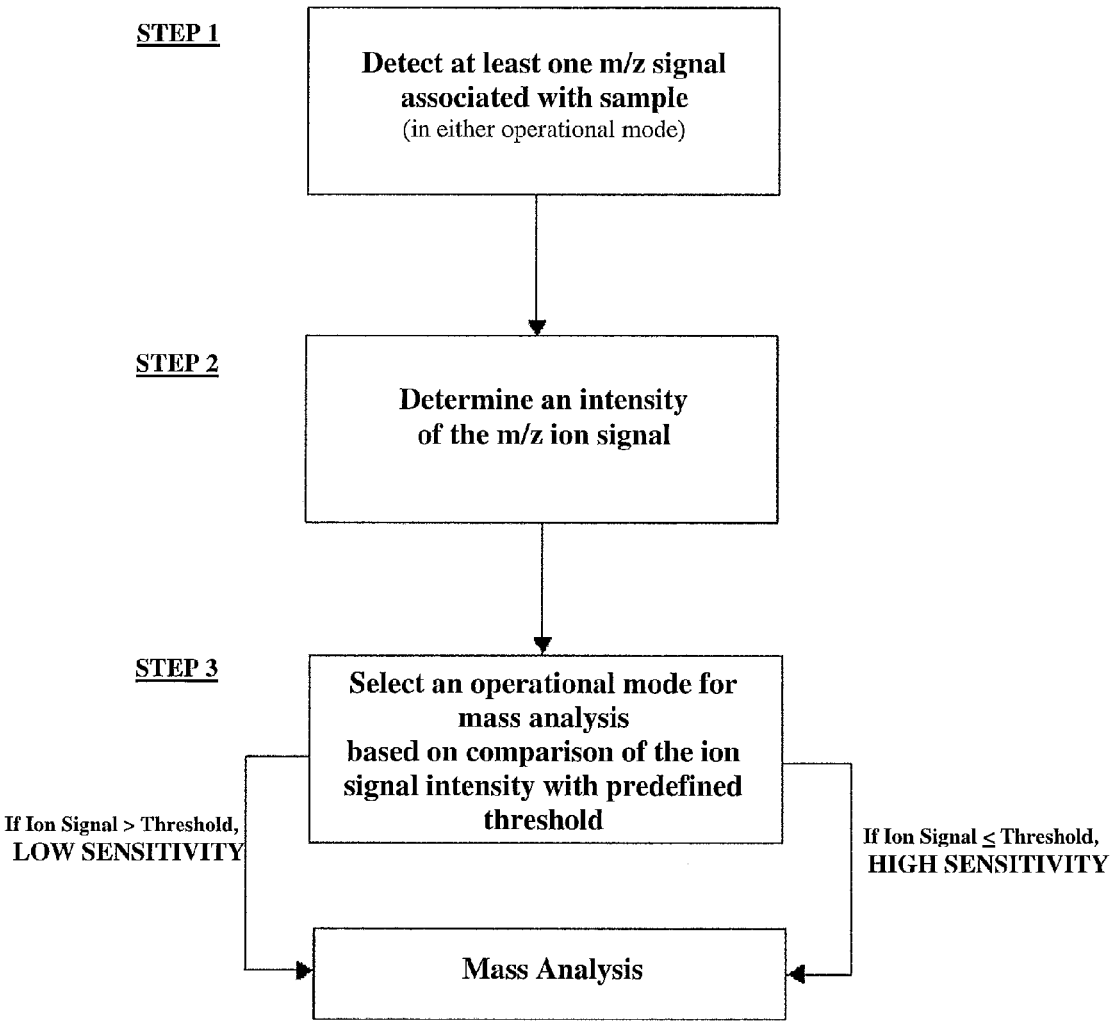
FIG. 1 is a flow diagram illustrating various steps in an exemplary embodiment of a method for performing mass analysis of a sample in accordance with the applicants' teachings.

FIG. 1 is a flow chart depicting various steps in a method according to an embodiment of the applicant's teachings for performing mass analysis of a sample using a mass spectrometer that is capable of operating in two different operational modes. In step (1), the mass spectrometer is utilized in one of those operational modes to detect at least one m/z ion signal associated with the sample. In many embodiments, the two operational modes provide different sensitivities, where the sensitivity of an operational mode refers to the lowest concentration of ions that can be detected using the mass spectrometer in that mode. In some embodiments, the initial detection of at least one m/z ion signal associated with the sample is achieved using the mass spectrometer in the operational mode that provides a lower sensitivity.

In step (2), the intensity of the detected m/z ion signal can be determined, and in step (3), one of the two operational modes can be selected based on comparison of the measured ion signal intensity with a predefined threshold to perform additional mass analysis of the sample. For example, in some embodiments, if the intensity of the ion signal exceeds the threshold, the operational mode providing a lower sensitivity is used and if the intensity is equal to or less than the threshold, the operational mode providing a higher sensitivity is used for further mass analysis of the sample.

In some embodiments, the above method for mass analysis of a sample can be practiced using a mass spectrometer that includes at least two quadrupole instruments, where one quadrupole instrument is configured to operate as a mass resolving filter and the other quadrupole instrument is configured to operate either as a mass resolving filter or as a linear ion trap, e.g., in response to control signals provided by a controller. Thus, the mass spectrometer can be used in the following two operational modes: (a) both quadrupole instruments operating as mass resolving filters (herein "PI mode") or (b) one of the quadrupole instruments operating as a mass resolving filter and the other operating as a linear ion trap (herein "EPI mode"). As discussed in more detail below, in some embodiments, a collision cell, e.g., in the form of a third quadrupole instrument, can be disposed between the two quadrupole instruments.

Figure 2:
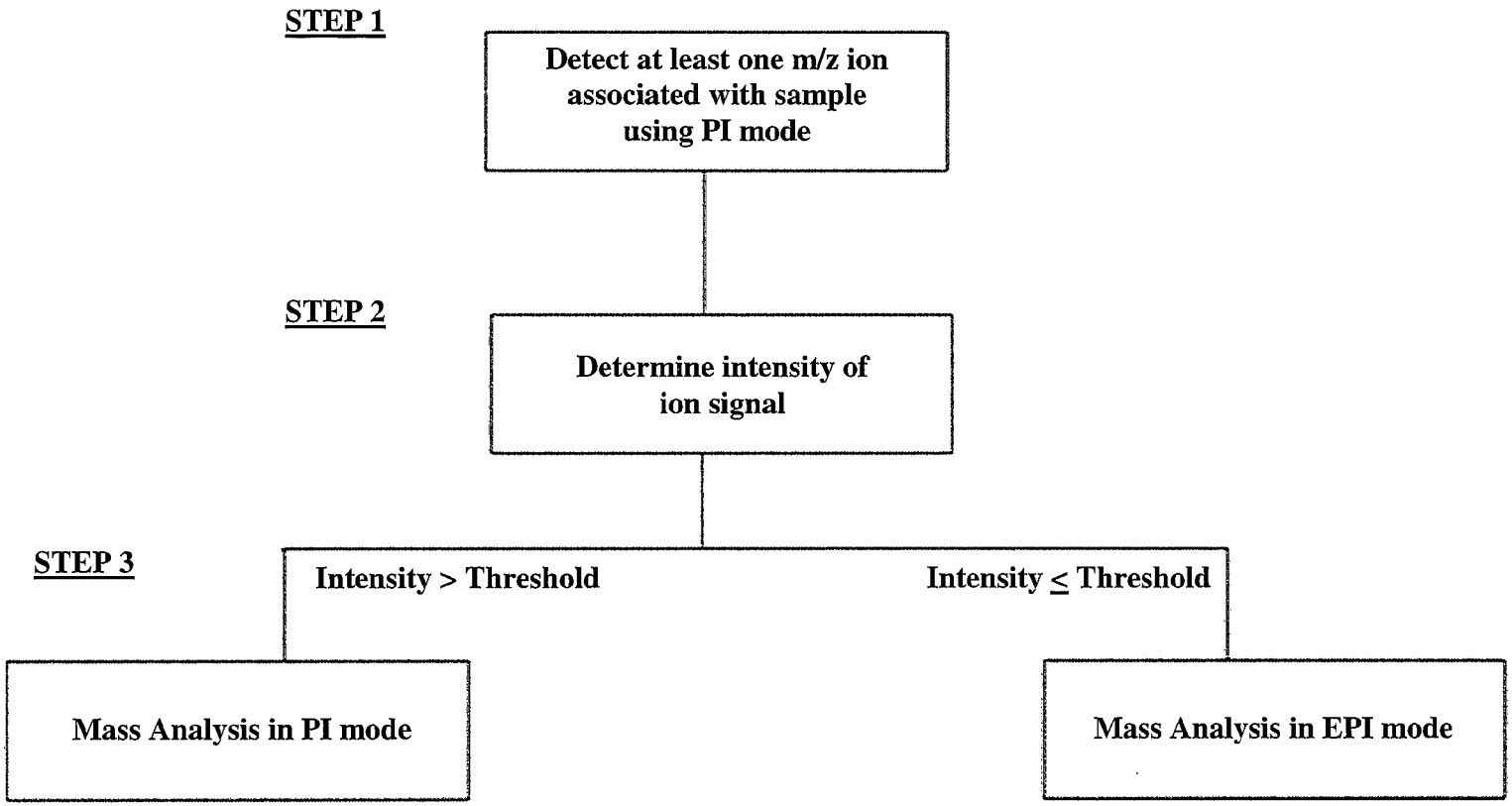
FIG. 2 is a flow diagram illustrating various steps in an exemplary embodiment for performing mass analysis of a sample using a mass spectrometer having two tandem quadrupole instruments in accordance with the applicants' teachings.

With reference to the flow chart of FIG. 2, in step (1) of an embodiment of such a method, at least one m/z ion signal associated with the sample is detected by using the mass spectrometer, e.g., by operating the mass spectrometer in the PI mode. For example, in some embodiments, at least one MRM transition of the sample can be detected. In some embodiments, at least one SIM transition of the sample can be detected. In some embodiments, a mass scan covering a range of m/z values can be performed to survey for at least one m/z ion signal associated with the sample. In step (2), the intensity of this ion signal can be determined, and in step (3), based on comparison of the measured intensity with a predefined threshold, the mass spectrometer can be operated in the PI mode or the EPI mode to perform mass analysis of the sample. For example, if the intensity of the ion signal exceeds the threshold, the PI mode is selected, and if the intensity of the ion signal is equal to or less than the threshold, the EPI mode is selected.

In various embodiments, the use of the PI mode when the intensity of the ion signal exceeds the predefined threshold can avoid problems due to adverse space charge conditions that can arise when using the mass spectrometer in the EPI mode for the analysis of high-concentration analytes (such space charge conditions that can arise in linear ion traps can also have adverse effects upon the performance of library searches based on the acquired mass spectra). Further, the use of the EPI mode when the intensity of the ion signal is equal to or less than the predefined threshold can provide increased sensitivity for the analysis of low-concentration analytes (e.g., analysis of trace amounts of analytes). In this manner, workflows can be implemented that combine quantitative information regarding at least one ion signal associated with a sample to trigger an appropriate qualitative analysis of the sample. For example, the intensity of an MRM transition can be employed as an indicator for selecting the PI or EPI mass analysis mode.

FIG. 3 illustrates an exemplary mass spectrometer system 10 according to an embodiment of the applicants' teachings that comprises an ion source 12, e.g., an electrospray ion source, for generating ions that pass successively through apertures provided in a curtain plate 14, an orifice plate 16, and a skimmer 18 to enter an evacuated chamber 20, which in some embodiments can be maintained at a pressure of approximately $6\times10^{-3}$ Torr.

The illustrative spectrometer system 10 further comprises a quadrupole ion guide Q0 that provides focusing of the ions and guides the ions to a subsequent analyzer chamber, which is separated by a differential pumping aperture IQ1 from the chamber in which Q0 is disposed, A first quadrupole mass instrument Q1, which is configured to operate as an RF/DC mass resolving filter (mass spectrometer), receives the ions after their passage through the ion guide Q0. A short ion lens 22, e.g., a Brubaker lens, is located in front of the Q1 quadrupole mass spectrometer to provide focusing of the ions. In this illustrative embodiment, the Q0 quadrupole rods are capacitively coupled to an RF drive voltage (e.g., 1 MHz drive voltage) that is applied to Q1.

Suitable RF/DC voltages can be applied to the rods of the first quadrupole Q1 such that Q1 would operate in a mass resolving mode. By way of example, parameters for the applied RF and DC voltages can be selected in a manner known in the art so that quadrupole Q1 establishes a quadrupolar electromagnetic field having an m/z passband. Ions having m/z ratios that fall within the m/z passband can traverse Q1 to reach subsequent stages of the spectrometer as discussed below. In contrast, ions having m/z ratios that fall outside the passband can have unstable trajectories, which can cause them to hit the rods and discharge. In some cases, the amplitudes of the RF and/or DC voltages applied to the rods of Q1 can be varied to scan Q1 over a range of values to allow the passage of ions having successive m/z values through Q1.

The ions passing through Q1 are directed to a collision cell q2, which in this illustrative embodiment is an enclosed LINAC quadrupole array and includes lenses IQ2 and IQ3 at its entrance and exit apertures, respectively. A variety of gases can be employed as a collision gas. For example, in some embodiments, an inert collision gas (e.g., helium, argon or nitrogen) can be employed while in some other embodiments the collision gas can be reactive. In some embodiments, some of the ions entering the collision cell are fragmented, e.g., via collision-induced dissociation (CID). In some embodiments, certain ions can react with a reactive gas to generate fragment ions. A typical operating pressure in q2 can be about $5\times10^{-3}$ Torr, though other operating pressures can also be employed.

Another quadrupole instrument Q3 positioned downstream from the collision cell q2 can receive ions, e.g., precursor and fragment ions, from the collision cell q2. In some embodiments, the quadrupole rod array of Q3 can have the same mechanical structure as that of the quadrupole rod array of Q1. In other embodiments, the mechanical structure of the quadrupole rod array of Q can be different than that of the Q1. As discussed in more detail below, in some embodiments, the quadrupole instrument Q3 can be operated based on control signals generated by a controller as a mass resolving filter or as a linear ion trap.

Two additional lenses 24 and 26 are disposed downstream from Q3. In some embodiments, the lens 24, also referred to herein as the "Exit lens," can include a mesh-covered aperture (e.g., an aperture of about 8 mm) and the lens 26 can include a clear aperture (e.g., an aperture of about 8 mm).

A detector 28 can detect ions exiting the quadrupole instrument Q3. In some embodiments, the detector 28 can comprise a discrete dynode electron multiplier that is operated in pulse counting mode, a micro-channel plate (MCP detector), or any other suitable detector known in the art. In some embodiments, a digital converter (not shown), such as a time to digital converter or a fast transient recorder, can be coupled to the detector.

In embodiments in which a pulse counting detector is employed, the total number of counts corresponding to a particular m/z ion signal represents the intensity of that signal.

With continued reference to FIG. 3, a power supply 30 applies RF and/or DC potentials to various rods of the quadrupole Q3, and the lenses 24 and 26. In some embodiments, the power supply 30 also provides the requisite RF and/or DC potential to the rode array of Q1 and Q2 as well the lenses IQ1, 22, IQ2 and IQ3. Alternatively, one or more separate power supplies can be employed to provide these RF and/or DC potentials. Yet, in some embodiments, the RF voltage applied to one or more rods of the quadrupole array of Q3 (e.g., at 1 MHz) can drive the collision cell rods via a capacitive coupling. A typical operating pressure in Q3 is about $3.5\times10^{-5}$ Torr, though other pressures can also be employed.

With continued reference to FIG. 3, the illustrative mass spectrometer 10 can further comprise a controller 32 that is in electrical communication with the detector 28, e.g., directly or via a digital converter module linked to the detector, to receive ion signal data therefrom. The controller 32 can also be in communication with the power supply 30 to apply control signals thereto. As discussed in more detail below, in some embodiments, the controller can utilize the ion intensity data or other information received from the detector as a control variable for controlling the operational mode of the spectrometer 10. For example, in response to control signals received from the controller 32, the power supply 30 can apply the requisite RF and/or DC voltages to the quadrupole rod array of Q3 and the lens 24 to configure Q3 to operate as a linear ion trap in a manner known in the art. Alternatively, the controller 32 can instruct the power supply 30, via application of control signals, to configure Q3 to operate as a mass resolving filter, rather than a linear ion trap.

When operating as a linear ion trap, different approaches can be used to mass-selectively scan (i.e. eject) ions trapped in the quadrupole Q3 to the detector 28 for mass-differentiated detection. In one approach, ions of different m/z ratios can be sequentially energized so as to overcome the exit barrier. Alternatively, mass selective axial ejection (MSAE) can be employed, as described in detail in U.S. Pat. No. 6,177,668 hereby incorporated by reference in its entirety, to selectively eject ions out of Q3 operating as a linear ion trap for detection by the detector 20.

The controller 32 can be implemented using known electrical components, such as suitable integrated circuits, and known engineering methods. For example, the controller 32 can include one or more processors, memory modules, communication modules for communicating with the detector 28 and the power supply 30, as well as software instructions for implementing the applicants' teachings. In some embodiments, the controller 32 can further comprise one or more buffers and signal processing components that can facilitate the analysis of signals received from the detector 28.

In use, in some embodiments, the mass spectrometer 10 can be employed to obtain at least one m/z signal associated with a sample under study. For example, in some embodiments, initially, a selected MRM transition signal of a sample can be detected by using the ion source 12 to ionize the sample to provide an ion beam. The Q1 quadrupole can be configured to allow the passage of the parent ions, and the Q3 quadrupole can be configured, via control signals generated by the controller 14, to operate as a mass resolving filter, rather than a linear ion trap, to allow the passage of the parent ions as well as one or more fragments of the parent ions to the detector 28 for detection.

The controller 32 can receive MRM transition signal detected by the detector 14. The controller can be configured to process the received signal so as to determine an intensity of the signal, e.g., based on total pulse counts and/or pulse counts per second reported by the detector. The controller can employ the signal intensity as a control variable for maintaining Q3 as a mass resolving filter for continued mass analysis of the sample or for changing the operational mode of Q3 from a mass resolving filter to a linear ion trap for further mass analysis of the sample. For example, in addition to RF voltage applied to the quadrupole rod array of Q3, the controller can cause the power supply to apply a retarding potential to the Entrance lens IQ3 and to the Exit lens 24 to configure Q3 as a linear ion trap. Operation of a quadrupole as a linear ion trap is more fully described in "A new linear ion trap mass spectrometer," authored by James W. Hager and published in Rapid Communications in Mass Spectrometry (2002; 16:512-526), which is incorporated by reference herein.

For example, the controller can be configured to compare the intensity of the MRM transition with a predefined threshold to determine whether the intensity exceeds that threshold or is equal or less than that threshold. By way of example, in some embodiments, the threshold can be set as 5000 counts. If the signal intensity exceeds the threshold, the controller 14 can continue the operation of Q3 as a mass resolving filter. In other words, the spectrometer 10 can be operated in the PI mode. An ion signal intensity exceeding the threshold can indicate a high concentration of ions. Operating the mass spectrometer 10 in the PI mode, rather than in EPI mode, for mass analysis of such high ion concentration analytes can avoid adverse space charge effects that can arise when a linear ion trap is employed for mass analysis of high ion concentration analytes. Conversely, if the MRM transition intensity is equal to or less than the threshold, the controller 30 can configure the Q3 quadrupole to operate as a linear ion trap while Q1 quadrupole continues to operate as a mass resolving filter. In other words, the mass spectrometer 10 can be operated in the EPI mode. An ion signal intensity that is equal to or less than the threshold can indicate a low concentration of ions. Operating the mass spectrometer 10 in the EPI mode for mass analysis of such low ion concentration analytes can provide enhanced sensitivity. In various embodiments, the ion intensity can be determined as a height of at least one ion signal in a mass spectrum of the sample.

Although the above embodiment was described in connection with detecting an MRM transition, in other embodiments, other types of ion signals can be employed to determine whether to operate the mass spectrometer in the PI operational mode or in the EPI operational mode. For example, the controller can process SIM ion signals received from the detector 28 to trigger the operation of the Q3 as a mass resolving filter or as a linear ion trap, e.g., by instructing the power supply 30 to apply appropriate RF and/or DC potentials to the quadrupole rod array of Q3.

In some embodiments, a mass spectrometer disclosed in an article entitled "Product ion scanning using a Q-q-$Q_{linear}$ ion trap (Q TRAP®) mass spectrometer," authored by James W. Hager and J. C. Yves Le Blanc and published in Rapid Communications in Mass Spectrometry (2003; 17: 1056-1064) can be modified in accordance with the applicants' teachings provided herein to implement the applicants' teachings.

As discussed above, the mass spectrometer 10 can have two general operational modes: (a) the PI mode, in which the third quadrupole Q3 can be configured as a mass resolving spectrometer, and (b) the EPI mode, in which the third quadrupole Q3 can be configured as a linear ion trap mass spectrometer. It should be understood, however, that the mass spectrometer 10 represents only one possible MS configuration that may be utilized to implement the applicants' teachings.

Further, the predefined threshold can be selected in various ways. In some embodiments, the threshold can be manually selected by a user. In some embodiments, a reference ion intensity, e.g., an m/z ion intensity associated with an analyte previously obtained by the mass spectrometer can be employed as the predefined threshold. In some embodiments, the selected threshold value can automatically be calculated based on various information, such as the detected intensity or intensities of at least one m/z ion signal, and/or the distribution of intensity peaks within the sample. For example, if most of the ions are skewed to a lower-mass region, the threshold value may be set differently than if the ions are evenly distributed across the measured mass range or if the majority of the ions have a higher mass. Since in some embodiments, the detector may be better able to handle high intensity signals from samples if the masses are skewed to the lower mass region, in some embodiments, the threshold value can decreased when the ions are skewed to the lower mass region compared to embodiments where the masses are not skewed. In some embodiments, one m/z ion signal can be monitored to determine the threshold value (e.g., the parent ion m/z is measured). In other embodiments, 2, 3, 4, 5, 6, 7, 8 or more m/z ion signals can be monitored to determine the threshold value. In other embodiments, a range of m/z values, including, for example, the parent ion and several daughter ions m/z values can be monitored. In yet other embodiments, the entire range of m/z values measured by the detector can be monitored to determine the threshold value.

In some embodiments, predetermined threshold can be set at a constant value. For example, in some embodiments, the predefined threshold can be selected as counts, e.g., 3000, 4000, 5000, 6000, or 7000 counts. In some embodiments, the predefined threshold can be set as 3, 3.5, 4, 4.5, 5, 5.5, 6, 6.5, 7, 7.5, or 8 million counts. In other embodiments the threshold value can be adjusted, for example, based on the charge capacity of the linear ion trap utilized in one operational mode of the mass spectrometer. In yet other embodiments, the threshold can be defined based on a combination of the total ion count and the distribution of the ion masses.

While the above description provides examples and specific details of various embodiments, it will be appreciated that some features and/or functions of the described embodiments admit to modification without departing from the scope of the described embodiments. The above description is intended to be illustrative of the applicants' teachings, the scope of which is limited only by the language of the claims appended hereto.

The invention claimed is:

1. In a mass spectrometer comprising at least first and second quadrupole instruments, and wherein said second quadrupole instrument is capable of operating in at least two operational modes, a method of performing mass analysis of a sample, comprising:

passing a plurality of ions obtained from a sample through said quadrupole instruments to detect at least one ion associated with the sample, generating at least one m/z ion signal corresponding to said ion, determining an intensity of said at least one ion signal, selecting one of said operational modes of said second quadrupole instrument based on comparison of said determined ion signal intensity with a predefined threshold, and passing a plurality of ions obtained from the sample through the mass spectrometer while operating said second quadrupole instrument in said selected operational mode to obtain one or more mass spectra.

2. The method of claim 1, wherein said detection of at least one ion comprises operating said second quadrupole instrument in one of said operational modes that results in a lower ion detection sensitivity relative to another operational mode.

3. The method of claim 2, wherein the detection of at least one ion comprises scanning ions over a selected m/z range.

4. The method of claim 1, wherein said first quadrupole instrument is configured to operate as a mass resolving filter.

5. The method of claim 4, wherein one of said operational modes corresponds to said second quadrupole instrument operating as a mass resolving filter for product ion mode and another of said operational modes corresponds to said second quadrupole instrument operating as a linear ion trap for enhanced product ion mode.

6. The method of claim 5, wherein said step of selecting one of said operational modes comprises selecting said product ion mode if said ion intensity is greater than said predefined threshold.

7. The method of claim 6, wherein said step of selecting one of said operational modes comprises selecting said product ion mode if said ion intensity is at least 5% greater than said predefined threshold.

8. The method of claim 7, wherein said step of selecting one of said operational modes comprises selecting said product ion mode if said ion intensity is at least 10% greater than said predefined threshold.

9. The method of claim 6, wherein said step of selecting one of said modes comprises changing from said product ion mode to said enhanced product ion mode for mass analysis of the sample if the intensity of said at least one ion signal is equal to or less than said threshold.

10. The method of claim 5, wherein said detection of at least one ion comprises operating said mass spectrometer in said product ion mode to scan ions over a selected m/z range.

11. The method of claim 10, wherein said detection of ion signal comprises using said mass spectrometer to obtain m/z data corresponding to at least one multiple reaction monitoring (MRM) transition of said sample.

12. The method of claim 11, wherein said step of determining the ion signal intensity comprises measuring an intensity of said at least one multiple reaction monitoring (MRM) transition.

13. The method of claim 5, wherein said mass spectrometer further comprises a collision cell disposed between said first and second quadrupole instruments and configured to cause collisional ion fragmentation.

14. The method of claim 13, wherein the step of selecting one of said operational modes comprises selecting said product ion mode to perform mass analysis of the sample if said measured multiple reaction monitoring (MRM) intensity is above said threshold and selecting said enhanced product ion mode to perform mass analysis of the sample if said measured multiple reaction monitoring (MRM) transition intensity is equal to or less than said threshold.

15. The method of claim 5, wherein said detection of ion comprises using said mass spectrometer to obtain m/z data corresponding to an selected ion monitoring (SIM) transition of said sample.

16. The method of claim 15, wherein said step of determining the ion signal intensity comprises measuring an intensity of said selected ion monitoring (SIM) transition.

17. The method of claim 16, wherein the step of selecting one of said operational modes comprises selecting said product ion mode to perform mass analysis of the sample if said measured SIM intensity is greater than the threshold and selecting said enhanced product ion mode to perform additional mass analysis of the sample if said measured SIM intensity is equal to or less than said threshold.

18. The method of claim 1, wherein said ion intensity is determined as a height of at least one ion signal in a mass spectrum of the sample.

19. The method of claim 1, wherein said ion intensity is determined as a number of pulses generated by a detector in response to detection of said ion.

20. The method of claim 1, wherein said predefined threshold is at least about 5000 pulses generated by a detector.

* * * * *